US008890912B2

(12) United States Patent
Taki et al.

(10) Patent No.: US 8,890,912 B2
(45) Date of Patent: Nov. 18, 2014

(54) COLOR ERASING APPARATUS

(75) Inventors: Hiroyuki Taki, Shizuoka-ken (JP); Hiroyuki Tsuchihasi, Shizuoka-ken (JP); Takahiro Kawaguchi, Shizuoka-ken (JP); Isao Yahata, Shizuoka-ken (JP); Yoshiaki Sugizaki, Shizuoka-ken (JP); Kikuo Mizutani, Shizuoka-ken (JP); Ken Iguchi, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Hiroyuki Hazu, Shizuoka-ken (JP); Yoichi Yamaguchi, Shizuoka-ken (JP); Hiroyuki Sugiyama, Shizuoka-ken (JP); Yuichi Saito, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 45 days.

(21) Appl. No.: 13/400,523

(22) Filed: Feb. 20, 2012

(65) Prior Publication Data

US 2012/0306982 A1 Dec. 6, 2012

Related U.S. Application Data

(60) Provisional application No. 61/493,392, filed on Jun. 3, 2011, provisional application No. 61/492,808, filed on Jun. 3, 2011, provisional application No. 61/495,270, filed on Jun. 9, 2011, provisional application No. 61/521,349, filed on Aug. 8, 2011, provisional application No. 61/495,272, filed on Jun. 9, 2011, provisional application No. 61/499,143, filed on Jun. 20, 2011.

(30) Foreign Application Priority Data

Jan. 11, 2012 (JP) ..... P2012-002686

(51) Int. Cl.

| | |
|---|---|
| ***B41J 2/32*** | (2006.01) |
| ***B41M 7/00*** | (2006.01) |
| ***B41J 29/36*** | (2006.01) |

(52) U.S. Cl.

CPC ..... *B41J 29/36* (2013.01); *B41M 7/0009* (2013.01); *B41J 2/32* (2013.01); *B41J 2202/37* (2013.01)

USPC ..... 347/179

(58) Field of Classification Search

USPC ..... 347/179

See application file for complete search history.

(56) References Cited

U.S. PATENT DOCUMENTS 6,154,243 A 11/2000 Tatewaki et al.
7,087,918 B2 * 8/2006 Hall ..... 250/588

(Continued)

FOREIGN PATENT DOCUMENTS

JP 06-242638 * 9/1994
JP H06-242638 9/1994

(Continued)

OTHER PUBLICATIONS

Office Action dated May 5, 2014, filed in corresponding Chinese Patent Application No. 201210040059.4 (with English translation).

*Primary Examiner* — Huan Tran
(74) *Attorney, Agent, or Firm* — Patterson & Sheridan LLP

(57) ABSTRACT

According to one embodiment, a color erasing apparatus includes a color erasing section which erases a color of an image formed with an erasable color material on a sheet conveyed at first speed, a reading section which reads an image on the surface of the sheet conveyed at second speed higher than the first speed, a first conveying section, and a second conveying section. The first conveying section includes a first conveying roller arranged downstream in a sheet conveying direction of the color erasing section and conveys the sheet at the first speed. The second conveying section includes a second conveying roller arranged upstream in the sheet conveying direction of the reading section and in a position where the second conveying roller nips the conveyed sheet simultaneously with the first conveying roller. The second conveying section conveys the sheet to the reading section at the second speed.

16 Claims, 7 Drawing Sheets

(56) References Cited

U.S. PATENT DOCUMENTS

| | | | | |
|---|---|---|---|---|
| 8,289,353 | B2 * | 10/2012 | Taguchi et al. | 347/179 |
| 8,427,516 | B2 * | 4/2013 | Kawaguchi et al. | 347/171 |
| 8,441,508 | B2 * | 5/2013 | Taki et al. | 347/179 |
| 8,451,304 | B2 * | 5/2013 | Taki et al. | 347/177 |
| 8,456,497 | B2 * | 6/2013 | Iguchi et al. | 347/179 |
| 8,489,010 | B2 | 7/2013 | Taki et al. | |
| 2010/0118361 | A1 | 5/2010 | Iguchi | |
| 2010/0194839 | A1 | 8/2010 | Taguchi et al. | |
| 2010/0234735 | A1 * | 9/2010 | Kosaku | 600/459 |
| 2010/0315475 | A1 * | 12/2010 | Taki et al. | 347/179 |
| 2010/0321457 | A1 * | 12/2010 | Kawaguchi et al. | 347/179 |
| 2010/0323286 | A1 * | 12/2010 | Iguchi et al. | 430/19 |
| 2010/0323287 | A1 * | 12/2010 | Yahata et al. | 430/19 |
| 2011/0033216 | A1 * | 2/2011 | Taki et al. | 399/341 |
| 2011/0222131 | A1 | 9/2011 | Yahata et al. | |
| 2011/0234736 | A1 * | 9/2011 | Taguchi et al. | 347/179 |
| 2012/0149562 | A1 * | 6/2012 | Iguchi et al. | 503/201 |
| 2012/0306985 | A1 * | 12/2012 | Iguchi et al. | 347/179 |

FOREIGN PATENT DOCUMENTS

| | | | |
|---|---|---|---|
| JP | 2002-091243 | | 3/2002 |
| JP | 2002-91243 | * | 3/2002 |
| JP | 2003-195433 | * | 7/2003 |
| JP | 2010-114807 | | 5/2010 |
| JP | 2010-130372 | * | 6/2010 |

* cited by examiner

COLOR ERASING APPARATUS

CROSS-REFERENCE TO RELATED APPLICATIONS

This application is based upon and claims the benefit of priority from the prior the U.S.A. Patent Application No. 61/493,392, filed on Jun. 3, 2011, and the prior the U.S.A. Patent Application No. 61/492,808, filed on Jun. 3, 2011, and the prior the U.S.A. Patent Application No. 61/495,270, filed on Jun. 9, 2011, and the prior the U.S.A. Patent Application No. 61/521,349, filed on Aug. 8, 2011, and the prior the U.S.A. Patent Application No. 61/495,272, filed on Jun. 9, 2011, and the prior the U.S.A. Patent Application No. 61/499,143, filed on Jun. 20, 2011, and Japanese Patent Application No. 2012-2686, filed on Jan. 11, 2012, and the entire contents all of which are incorporated herein by reference.

FIELD

Embodiments described herein relate generally to a color erasing apparatus for erasing a color of an image on a sheet.

BACKGROUND

There is a color erasing apparatus that erases a color of an image on a sheet subjected to image formation. The color erasing apparatus includes a color erasing section configured to apply heating processing to a sheet on which an image is formed with an erasable color material and erase a color of the image (the color material) on the sheet. The color erasing apparatus includes a reading section configured to read the image on the surface of the sheet. The color erasing apparatus determines, on the basis of the image read by the reading section, whether the sheet to be subjected to color erasing processing is color-erasable or whether the color erasing processing is successful.

The color erasing section of the color erasing apparatus erases a color of an image on the sheet by heating a conveyed sheet. In order for the color erasing section to surely perform the color erasing, the sheet conveyed through the color erasing section needs to be conveyed at appropriate conveying speed. On the other hand, in order for the reading section to surely read the image on the sheet, the sheet needs to be conveyed through the reading section at appropriate conveying speed. The conveying speed of the sheet passing through the color erasing section during the color erasing processing (hereinafter referred to as color erasing speed) and the conveying speed of the sheet passing through the reading section during reading processing or sorting processing (hereinafter referred to as reading speed) respectively depend on the performance of the color erasing section and the performance of the reading section. For example, the reading section could read the image on the sheet at the reading speed higher than the color erasing speed of the color erasing section. However, when a reduction in size of a conveying path is examined, the color erasing apparatus needs to convey the sheet to the reading section at the color erasing speed lower than the reading speed. In other words, the conveying speed of the sheet in the color erasing apparatus is controlled according to the lower conveying speed. Therefore, the performance of processing of the entire color erasing apparatus falls.

Therefore, there is a demand for a color erasing apparatus that can realize a reduction in size and improve processing performance.

DETAILED DESCRIPTION

In general, according to one embodiment, a color erasing apparatus (a decoloring apparatus) includes a color erasing section, a first conveying section, a reading section, and a second conveying section. The color erasing section erases a color of an image formed with an erasable color material on a sheet conveyed at first speed. The first conveying section includes a first conveying roller arranged downstream in a sheet conveying direction of the color erasing section and configured to convey the sheet and a first driving section configured to drive the first conveying roller. The first conveying section conveys the sheet, which passes through the color erasing section, at the first speed. The reading section reads an image on the surface of the sheet conveyed at second speed higher than the first speed. The second conveying section includes a second conveying roller arranged upstream in the sheet conveying direction of the reading section and in a position where the second conveying roller nips the conveyed sheet in cooperation and simultaneously with the first conveying roller and a second driving section configured to drive the second conveying roller. The second conveying section conveys the sheet to the reading section at the second speed.

Figure 1:
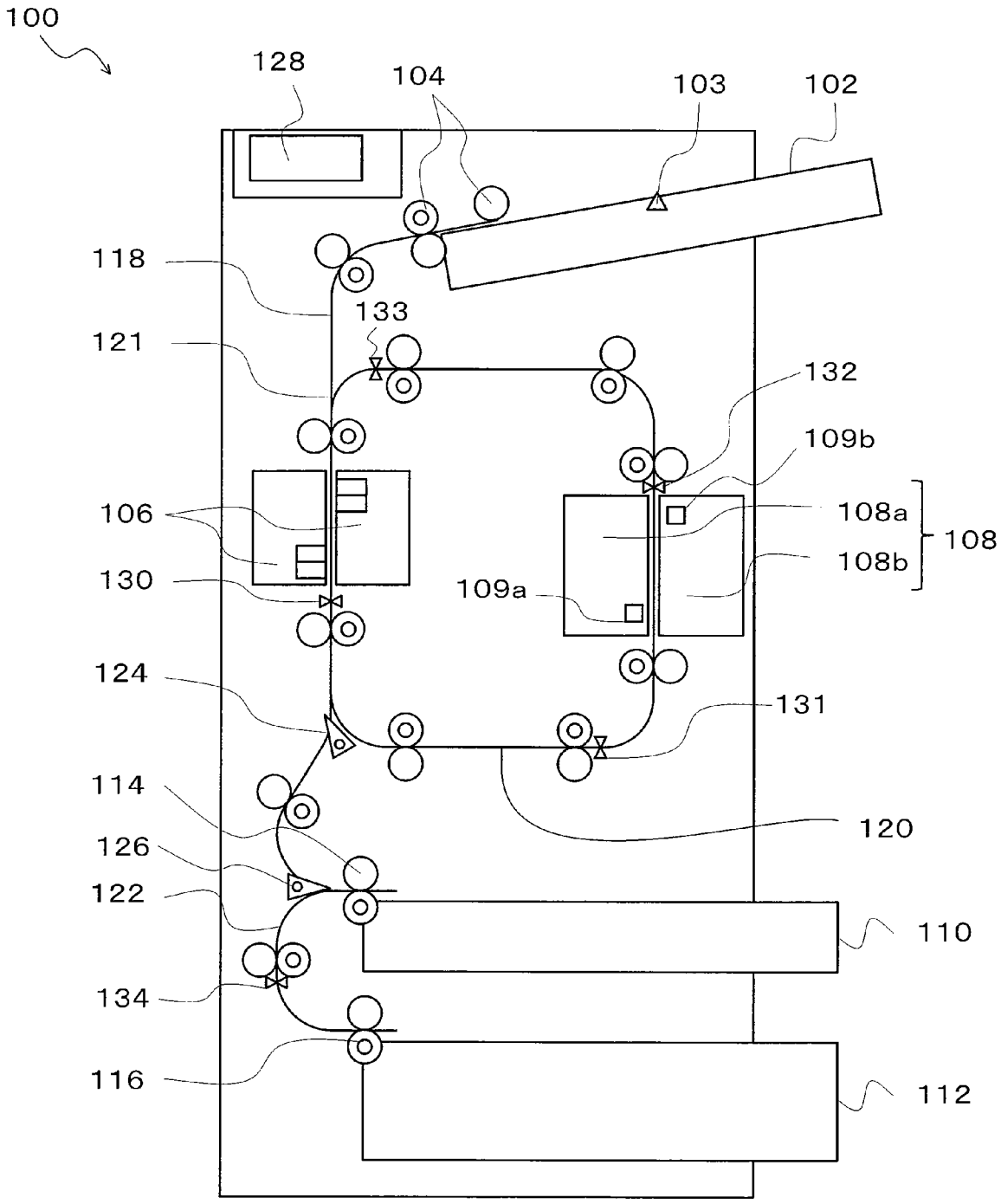
FIG. 1 is a schematic diagram for explaining the configuration of a color erasing apparatus.

FIG. 1 is a schematic diagram for explaining the configuration of the color erasing apparatus. A color erasing apparatus 100 subjects a sheet on which an image is formed with a "erasable color material" (hereinafter simply referred to as recording material) such as a color-erasable toner or color-erasable ink to "color erasing processing" for erasing a color of the image formed with the erasable color material. The color erasing apparatus 100 includes a paper feeding tray 102, a paper feeding member 104, a reading section 106, a color erasing section 108, a first tray 110, a second tray 112, discharge members 114 and 116, a first conveying path 118, a second conveying path 120, a third conveying path 122, a first diverting member 124, a second diverting member 126, and an operation section 128.

Sheets to be reused are stacked on the paper feeding tray 102. Sheets of various sizes such as A4, A3, B5, and the like are stacked on the paper feeding tray 102. The sheets stacked on the paper feeding tray 102 are, for example, sheets formed an image with a recording material, a color of which is erased by heating to temperature equal to or higher than predetermined temperature. The paper feeding member 104 includes a pickup roller, a sheet feeding roller, and a separation roller arranged to be opposed to the sheet feeding roller. The paper feeding member 104 feeds the sheets on the paper feeding tray 102 to the first conveying path 118 on the inside of the color erasing apparatus 100 one by one. The paper feeding tray 102 includes a detection sensor 103 configured to detect presence or absence of sheets on the paper feeding tray 102. The detection sensor 103 may be, for example, a micro sensor or a micro actuator. The first conveying path 118 forms a conveying path extending from the paper feeding tray 102 to the first tray 110. The first conveying path 118 conveys a fed sheet to the reading section 106 or the first tray 110.

The reading section 106 is arranged along the first conveying path 118 downstream in a sheet conveying direction of the paper feeding tray 102. The reading section 106 includes reading units such as CCD (Charge Coupled Device) scanners or CMOS sensors. In this embodiment, the reading section 106 reads images on first and second sides of a conveyed sheet. Specifically, the reading section 106 includes two reading units arranged along and across the first conveying path 118. The reading section 106 enables both-side reading of images on the conveyed sheet. A position where the reading units of the reading section 106 read the images on the sheet is referred to as reading position. The images read by the reading section 106 are stored in a storage device 210 (see FIG. 2) explained later. For example, before performing the color erasing processing, the color erasing apparatus 100 converts the images on the sheet read by the reading section 106 into an electronic form and stores the images in the storage device. Consequently, if data of the color-erased images is necessary later, it is possible to acquire the image data. A controller 200, which is explained later, determines whether the sheet is a color-erasable sheet or an un-reusable sheet on the basis of the images read by the reading section 106.

The first diverting member 124 functioning as a switching section is provided downstream the reading section 106. The first diverting member 124 switches a conveying direction of a conveyed sheet. The first diverting member 124 conveys a sheet, which is conveyed through the first conveying path 118, to the second conveying path 120 or the first tray 110. The second conveying path 120 branches from the first conveying path 118 at a branching point where the first diverting member 124 is arranged. The second conveying path 120 branching from the branching point conveys the sheet to the color erasing section 108. The second conveying path 120 meets with the first conveying path 118 at a meeting point 121 further upstream in the conveying direction than the reading section 106. In other words, the second conveying path 120 merges with the first conveying path 118 at the meeting point 121 between the paper feeding tray 102 and the reading section 106. Therefore, the second conveying path 120 enables the sheet conveyed from the reading section 106 to be conveyed to the reading section 106 again through the color erasing section 108. In other words, the color erasing apparatus 100 can control the first diverting member 124 and convey the sheet, which is fed from the paper feeding member 104, to the reading section 106, the color erasing section 108, and the reading section 106 in this order.

The first conveying path 118 includes the second diverting member 126 downstream the first diverting member 124. The second diverting member 126 guides the sheet, which is conveyed from the first diverting member 124, to the first tray 110 or the third conveying path 122. The third conveying path 122 conveys the sheet to the second tray 112.

The color erasing section 108 erases a color of an image on the conveyed sheet. For example, the color erasing section 108 heats, while being in contact with the conveyed sheet, the sheet to predetermined color erasing temperature to thereby erase a color of an image formed on the sheet with the recording material. For example, the color erasing section 108 of the color erasing apparatus 100 according to this embodiment includes two color erasing units 108*a* and 108*b* for first side color erasing and second side color erasing for the sheet. The color erasing units 108*a* and 108*b* are arranged to be opposed to each other across the second conveying path 120. The color erasing unit 108*a* comes into contact with the sheet from one side of the sheet and heats the sheet. The color erasing unit 108*b* comes into contact with the sheet from the other side of the sheet and heats the sheet. In other words, the color erasing section 108 erases colors of images on both sides of the conveyed sheet in one conveyance. A position where the color erasing units 108*a* and 108*b* heat the sheet, i.e., a position where heating sections (not shown) of the color erasing units 108*a* and 108*b* apply heat to the conveyed sheet and erase the colors of the images is referred to as color erasing position. The color erasing section 108 includes temperature sensors 109*a* and 109*b* configured to respectively detect the temperatures of the heating sections of the color erasing units 108*a* and 108*b*. The temperature sensors 109*a* and 109*b* may be either a contact type or a non-contact type.

The operation section 128 arranged in an upper part of a main body of the color erasing apparatus 100 includes a display section of a touch panel type and various operation keys. The operation keys include, for example, a ten key, a stop key, and a start key. A user instructs a functional operation of the color erasing apparatus 100 such as the start of color erasing or reading of an image on a sheet to be color-erased. The operation section 128 displays setting information, an operation status, and log information of the color erasing apparatus 100 or a message to the user explained later. The operation section 128 is not limited to the one arranged in the main body of the color erasing apparatus 100. For example, the operation section 128 may be connected to an operation device of an external apparatus via a network to be capable of being operated from the operation device on the outside. The external apparatus includes, for example, a personal computer or a tablet PC. In other words, the operation section 128 in this embodiment only has to be one with which the user can, for example, give an instruction of processing to the color erasing apparatus 100 and view information.

The discharge members 114 and 116 discharge sheets onto the first tray 110 and the second tray 112 vertically arranged in a lower part of the main body. For example, a reusable sheet, a color of an image on which is erased, is stacked on the first tray 110. A sheet determined as un-reusable is stacked on the second tray 112. The first tray 110 is referred to as reuse tray and the second tray 112 is referred to as reject tray. The sheets to be received by the reuse tray 110 and the reject tray 112 can be interchanged. The user only has to set, for example, from the operation section 128 what kinds of sheets are stacked on the respective trays, i.e., set conveyance destinations of the sheets. According to this setting, the second diverting member 126 switches a conveying path and guides the conveyed sheet to the first tray 110 or the third conveying path 122.

A conveying route of a sheet is changed as appropriate on the basis of a processing mode executed by the color erasing apparatus 100. The color erasing apparatus 100 includes plural processing modes. The color erasing apparatus 100 includes, for example, (1) a first color erasing mode for performing only the color erasing processing without performing image reading, (2) a second color erasing mode for performing the color erasing processing after reading an image, (3) a third color erasing mode for carrying out sorting (sorting processing) concerning reusability of the sheet after the color erasing processing without performing reading processing before color erasing, (4) a fourth color erasing mode for carrying out the color erasing processing and further carrying out the sorting processing after reading an image, and (5) a reading mode for carrying out the reading processing for an image without performing image color erasing. The modes can be selected on the operation section 128 of the color erasing apparatus 100. The selection of the processing modes is not limited to the operation section 128 of the color erasing apparatus 100 and may be set from an external terminal. In the first to fourth color erasing modes, the sheet is always conveyed to the color erasing section 108. On the other hand, in the reading mode, the color erasing apparatus 100 controls the first diverting member 124 and discharges the sheet through the reading section 106 without conveying the sheet to the color erasing section 108.

The color erasing apparatus 100 includes plural sheet detection sensors 130, 131, 132, 133, and 134 configured to detect sheets conveyed through the first to third conveying paths 118, 120, and 122. The sheet detection sensors may be, for example, micro sensors or micro actuators. The sheet detection sensors are arranged in appropriate positions of the conveying paths.

Figure 2:
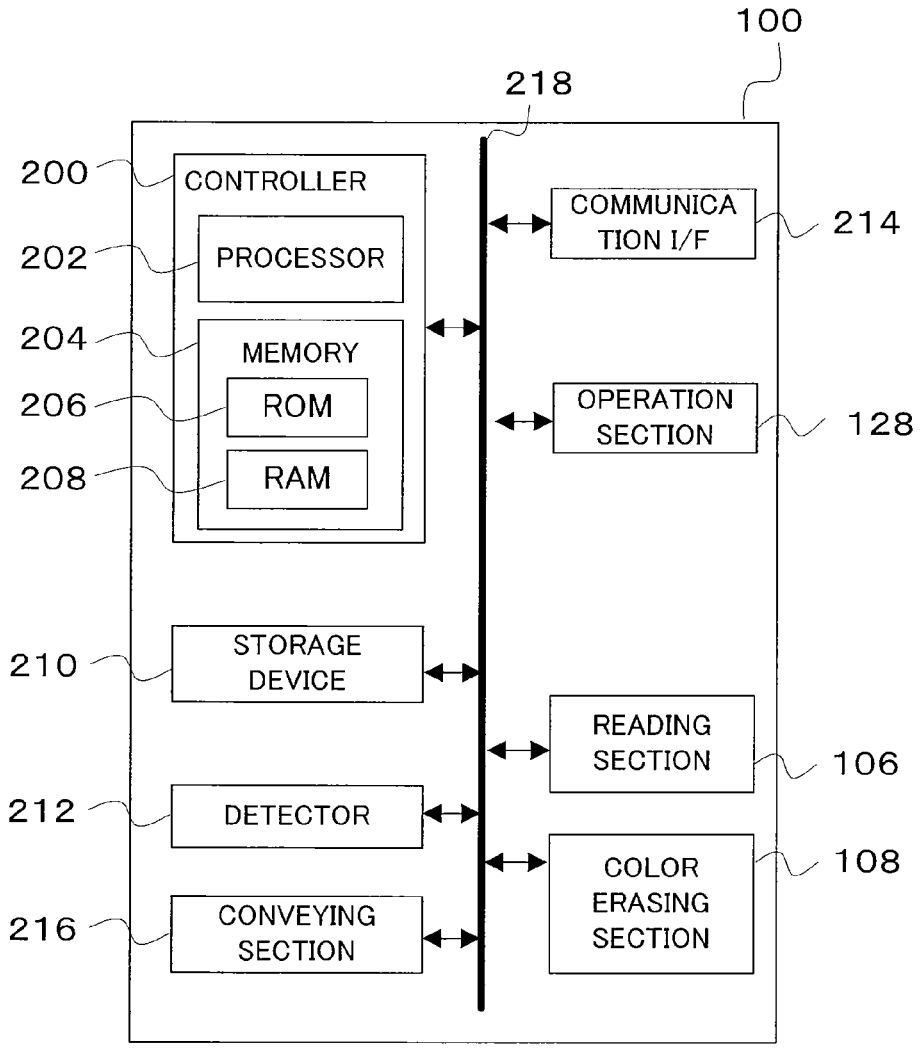
FIG. 2 is a block diagram for explaining a hardware configuration of the color erasing apparatus.

FIG. 2 is a block diagram for explaining a hardware configuration of the color erasing apparatus. The color erasing apparatus 100 includes a controller 200, a storage device 210, a detector 212, a communication interface (communication I/F) 214, a conveying section 216, a reading section 106, a color erasing section 108, and an operation section 128.

The controller (a controller) 200 includes a processor 202 including a CPU (Central Processing Unit) or an MPU (Micro Processing Unit) and a memory 204. The controller 200 controls the reading section 106, the color erasing section 108, and the operation section 128. The memory 204 is, for example, a semiconductor memory and includes a ROM (Read Only Memory) 206 that stores various control programs and a RAM (Random Access Memory) 208 that provides the processor 202 with a temporary work area. For example, the ROM 206 stores, for example, a printing ratio of a sheet set as a threshold for determining reusability and a density threshold for determining whether a color of an image is erased. The RAM 208 may temporarily store an image read by the reading section 106. The components of the color erasing apparatus 100 are connected via a bus 218.

The controller 200 controls the reading section 106, the color erasing section 108, and the other components according to, for example, the processing modes (1) to (5) set on the operation section 128. For example, if the first to fourth erasing modes are selected, the controller 200 causes the color erasing section 108 to erase a color of an image on a sheet. If the reading section 106 reads the sheet before the sheet is conveyed to the color erasing section 108 (the second color erasing mode and the fourth color erasing mode), the controller 200 stores an image read by the reading section 106 in the storage device 210 (hereinafter, reading processing). The controller 200 may determine whether prohibited data, color erasing for which should be prohibited, such as confidential data is included in data of the sheet image read by the reading section 106. After the color erasing section 108 erases the image on the sheet, if the reading section 106 reads the erased image on the sheet (the third color erasing mode and the fourth color erasing mode), the controller 200 determines, on the basis of the data of the image read by the reading section 106, from a state of a residual color after erasing on the sheet, whether the sheet is reusable. The controller 200 determines a conveyance destination of the sheet on the basis of a result of the determination (hereinafter, sorting processing). If the reading mode for reading an image is set without image color erasing being performed, the controller 200 controls the diverting member 124 to not guide the sheet to the color erasing section 108 after the reading section 106 reads the image on the sheet. The controller 200 stores the image read by the reading section 106 in the storage device 210.

The controller 200 controls the components on the inside of the apparatus on the basis of signals from the detector 212. As the detector 212, for example, there are the detection sensor 103, the temperature sensors 109*a* and 109*b*, and the sheet detection sensors 130, 131, 132, 133, and 134 shown in FIG. 1. The controller 200 determines presence or absence of a sheet on the paper feeding tray 102 on the basis of a signal from the detection sensor 103. The controller 200 detects the temperature of the heating sections of the color erasing units 108*a* and 108*b* using the temperature sensors 109*a* and 109*b* and controls the temperatures of the heating sections of the color erasing units 108 and 108*b*. The controller 200 grasps the positions of sheets in the first to third conveying paths 118, 120, and 122 using the sheet detection sensors 130, 131, 132, 133, and 134. For example, the controller 200 detects a sheet passed through the reading section 106 using the sheet detection sensor 130 near a position downstream the reading section 106.

The storage device 210 stores application programs and an OS. The application programs include a computer program for executing functions of the color erasing apparatus 100 such as a reading function by the reading section 106 and a color erasing function by the color erasing section 108. The application programs further include an application for a Web client (a Web browser) and other applications. The storage device 210 stores an image read by the reading section 106. The Storage device 210 stores the number of processed sheets processed by the color erasing apparatus 100. The Storage device 210 may be, for example, a hard disk drive or another magnetic storage device, an optical storage device, a semiconductor storage device such as a flash memory, or an arbitrary combination of these storage devices.

The communication I/F 214 is an interface connected to an external apparatus. The communication I/F 214 communicates with an external apparatus on a network via appropriate radio or wire such as IEEE802.15, IEEE802.11, IEEE802.3, and IEEE3304 including Bluetooth (registered trademark), infrared connection, and an optical connection. The communication I/F 214 may further include a USB connecting section to which a connection terminal of the USB standard is connected or a parallel interface. The controller 200 communicates with a multifunction peripheral and other external apparatuses via the communication I/F 214. For example, in the above explanation, the image read by the reading section 106 is stored by the storage device 210 of the color erasing apparatus 100. However, the storage of the image is not limited to the storage device 210. For example, the color erasing apparatus 100 may communicate with a user terminal (a personal computer), a multifunction peripheral, or a server, which is an external apparatus, via the communication I/F 214 and store the image in the storage device 210 of the external apparatus. Image data stored in the external apparatus only has to be read from an operation section of the multifunction peripheral or the user terminal. If the color erasing apparatus 100 includes login and logout functions in order to subject the user to personal authentication, during logout of the color erasing apparatus 100, the color erasing apparatus 100 may transmit data of the image stored in the RAM 208 or the storage device 210 of the color erasing apparatus 100 to the external apparatus and store the data.

The conveying section 216 includes plural conveying rollers arranged on the first conveying path 118, the second conveying path 120, and the third conveying path 122 and conveying motors configured to drive the conveying rollers. The controller 200 controls the driving of the conveying motors of the conveying section 216 to thereby control the conveying speed of a sheet. The speed of the sheet conveyed through the reading section 106 in order to read an image on the sheet is referred to as reading speed. Speed of the sheet conveyed through the color erasing section 108 in order to erase a color of the image on the sheet is referred to as color erasing speed. The conveying rollers and the conveying motors of the conveying section 216 are explained later.

The driving section 216 of the color erasing apparatus 100 that makes it possible to convey the sheet, which passes through the reading section 106, at the reading speed and convey the sheet, which passes through the color erasing section 108, at the color erasing speed lower than the reading speed is explained.

Figure 3:
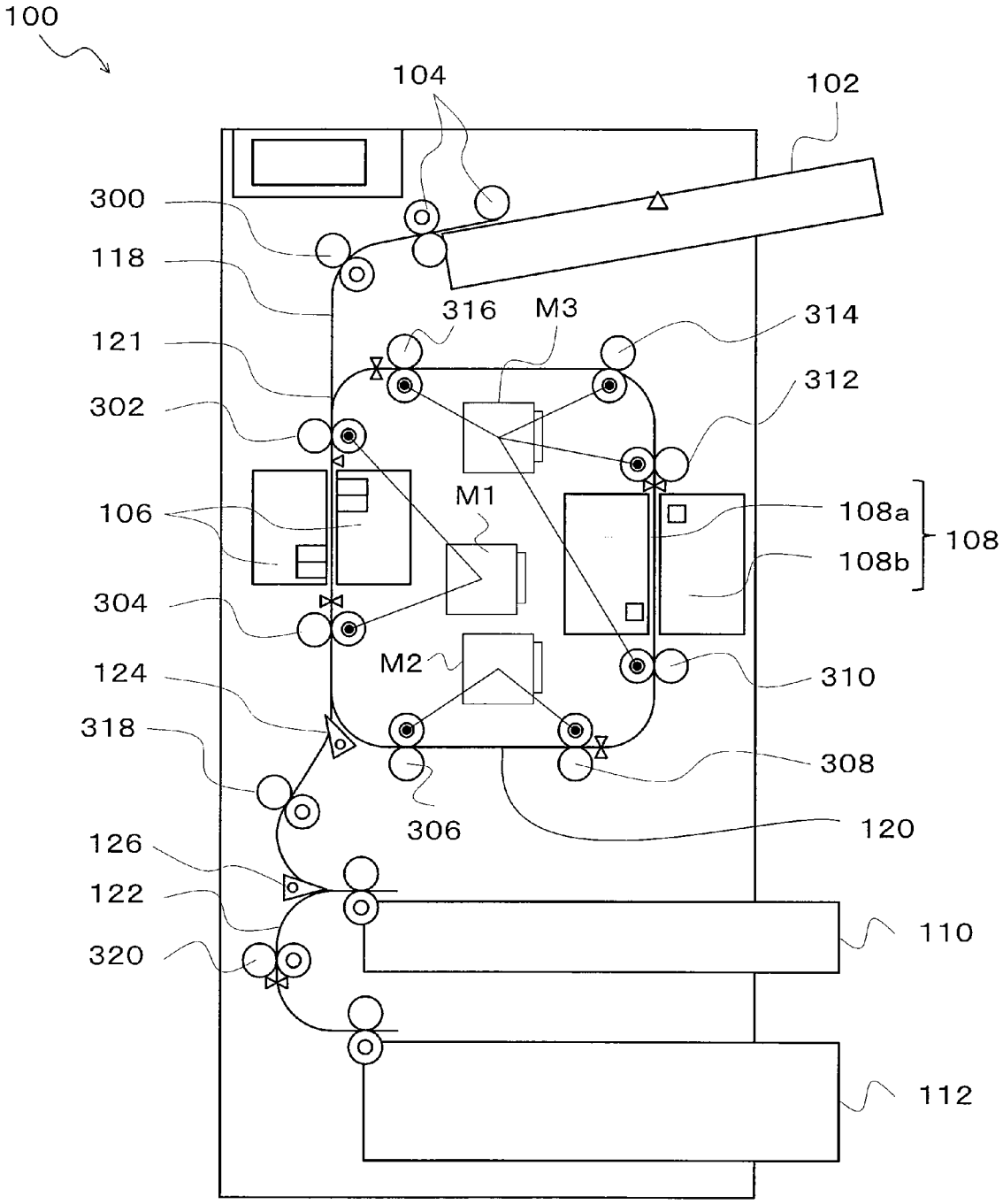
FIG. 3 is a schematic diagram for explaining plural conveying rollers arranged on conveying paths of the color erasing apparatus and conveying motors configured to drive the conveying rollers.
Figure 4:
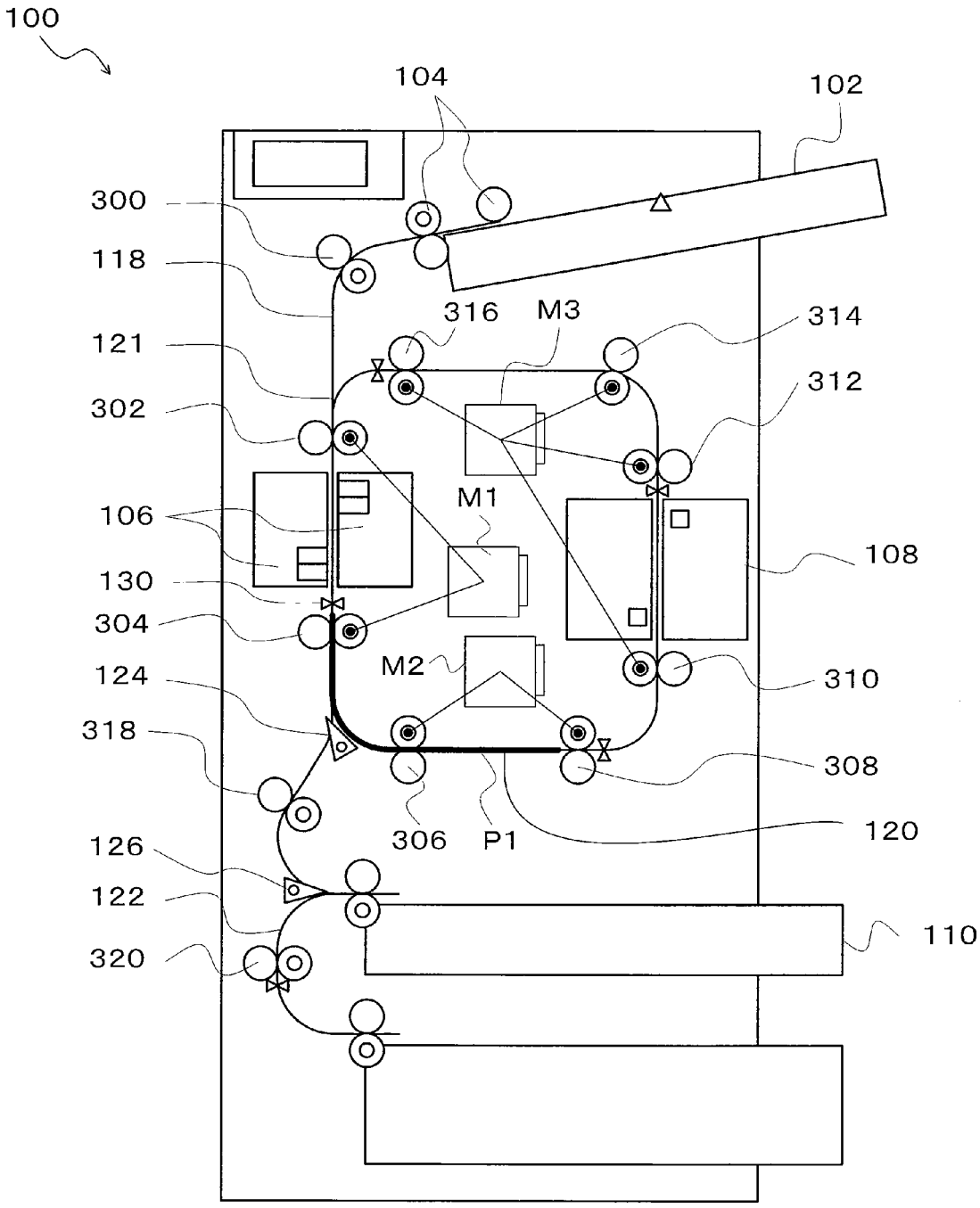
FIG. 4 is a diagram for explaining a configuration for reducing the conveying speed of a sheet from reading speed to color erasing speed when the sheet is conveyed from a reading section to a color erasing section.
Figure 5:
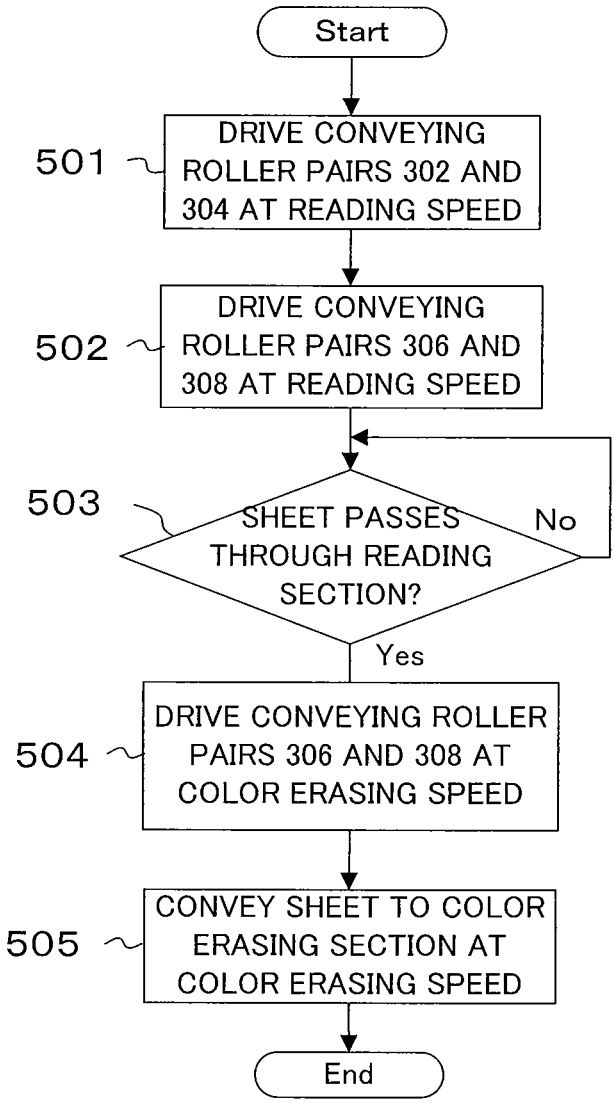
FIG. 5 is a flowchart for explaining a flow of reducing the conveying speed of the sheet from the reading speed to the color erasing speed when the sheet is conveyed from the reading section to the color erasing section.

FIGS. 3 to 5 are schematic diagrams for explaining the plural conveying rollers arranged on the conveying paths as the conveying section 216 of the color erasing apparatus 100 and the conveying motors configured to drive the conveying rollers. For simplification of the drawings, signs of a part of components redundant with those in FIG. 1 are omitted.

As shown in FIG. 3, the color erasing apparatus 100 includes plural conveying roller pairs 300, 302, 304, and 318 on the first conveying path 118. The conveying roller pair 300 is arranged between the paper feeding member 104 and the meeting point 121 where the second conveying path 120 meets with the first conveying path 118. The conveying roller pair 300 conveys a sheet, which is fed by the paper feeding member 104, in the direction of the reading section 106. The conveying roller pair 302 is arranged between the meeting point 121 and the reading section 106. The conveying roller pair 302 conveys the sheet to the reading section 106. The conveying roller pair 304 is arranged downstream in the conveying direction of the reading section 106 and conveys the sheet, which is conveyed from the reading section 106, to the first diverting member 124. The conveying roller pair 318 is arranged downstream in the conveying direction of the first diverting member 124 and conveys the sheet to the reuse tray 110. Among the plural conveying roller pairs, at least the conveying roller pairs 302 and 304 convey the sheet to the reading section 106 at the reading speed. Specifically, since it is undesirable to change conveying speed while the reading section 106 is reading an image on the sheet, the conveying speed of the sheet is maintained at the reading speed at least while the sheet passes the reading position of the reading section 106. The reading speed is conveying speed at which the reading section 106 can sufficiently read the image on the sheet.

The color erasing apparatus 100 includes plural conveying roller pairs 306, 308, 310, 312, 314, and 316 on the second conveying path 120. The conveying roller pairs 306, 308, and 310 are arranged between the first diverting member 124 and the color erasing section 108. The conveying roller pairs 306, 308, and 310 convey the sheet to the color erasing section 108 at the color erasing speed lower than the reading speed. The conveying roller pairs 312, 314, and 316 are arranged between the color erasing section 108 and the meeting point 121. The conveying roller pairs 312, 314, and 316 convey the sheet from the color erasing section 108 at the color erasing speed. Specifically, since it is undesirable to change the conveying speed during the color erasing processing, the conveying speed of the sheet is maintained at the color erasing speed at least while the sheet passes the color erasing position of the color erasing section 108. The color erasing speed is conveying speed lower than the reading speed and at which the color of the image on the sheet can be surely erased. Further, the conveying roller pairs 312, 314, and 316 arranged downstream the color erasing section 108 include one-way clutches in driving shafts. One-way clutch is a clutch mechanism for conveying a rotary movement in only one direction.

The color erasing apparatus 100 includes plural conveying roller pairs 320 on the third conveying path 122. The conveying roller pairs 320 convey the sheet to the reject tray 112.

In order to change the conveying speed between the reading section 106 and the color erasing section 108, the color erasing apparatus 100 includes plural conveying motors M1, M2, and M3 as driving sections configured to drive the plural conveying roller pairs explained above.

The conveying motor M1 drives the conveying roller pairs 302 and 304 on the first conveying path 118. The conveying motor M1 conveys the sheet, which passes through the reading section 106, at fixed reading speed with the conveying roller pairs 302 and 304.

The conveying motor M2 drives the conveying roller pairs 306 and 308 on the second conveying path 120. The conveying motor M2 decelerates, with the conveying roller pairs 306 and 308, the sheet conveyed at the reading speed to the color erasing speed.

The conveying motor M3 drives the conveying roller pairs 310, 312, 314, and 316 on the second conveying path 120. The conveying motor M3 conveys the sheet, which passes through the color erasing section 108, at fixed color erasing speed with the conveying roller pairs 310, 312, 314, and 316. Explanation of the conveying motors for the conveying roller pairs 300 and 318 is omitted.

FIGS. 4 and 5 are diagrams for explaining a mechanism for reducing the conveying speed of the sheet from the reading speed to the color erasing speed when the sheet is conveyed from the reading section 106 to the color erasing section 108. If the sheet is conveyed to the color erasing section 108 after the reading section 106 reads the image on the sheet, the color erasing apparatus 100 reduces the conveying speed of the sheet to the color erasing speed before the sheet reaches the color erasing section 108.

As shown in FIG. 4, at least the conveying roller pair 306 of the conveying roller pairs 306 and 308 is arranged in a position where the conveying roller pair 306 nips a conveyed sheet P1 in cooperation and simultaneously with the conveying roller pair 304 configured to convey the sheet P1 from the reading section 106. In this embodiment, the conveying roller pair 304 is arranged between the first diverting member 124 and the reading section 106. The conveying roller pair 306 is arranged between the first diverting member 124 and the color erasing section 108. On the other hand, the conveying roller pair 310 located upstream in the conveying direction of the color erasing section 108 does not nip the conveyed sheet P1 in cooperation and simultaneously with the conveying roller pair 304.

The operation of the conveying motors related to the conveying rollers shown in FIG. 4 is explained with reference to a flow shown in FIG. 5. As shown in FIG. 5, the controller 200 of the color erasing apparatus 100 drives, via the conveying motor M1, the conveying roller pairs 302 and 304 located on the first conveying path 118 at the reading speed (501). Specifically, the conveying roller pair 302 arranged upstream in the sheet conveying direction of the reading section 106 conveys a sheet to the reading section 106 at the reading speed. Similarly, the conveying roller pair 304 arranged near a position downstream in the sheet conveying direction of the reading section 106 conveys the sheet to downstream of the reading section 106 at the reading speed.

If the sheet is conveyed from the conveying roller pair 304, first, the controller 200 drives, via the conveying motor M2, the conveying roller pairs 306 and 308 arranged on the second conveying path 120 at the reading speed (502). The conveying roller pair 306 comes into contact with the conveyed sheet in cooperation and simultaneously with the upstream conveying roller pair 304 and conveys the sheet to the color erasing section 108.

The controller 200 determines, via the sheet detection sensor 130, whether the trailing end of the conveyed sheet is detected. Specifically, the controller 200 determines whether the trailing end of the sheet conveyed at the reading speed by the conveying roller pair 304 located on the first conveying path 118 and the conveying roller pair 306 located on the second conveying path 120 passes the reading position of the reading section 106 (503). If the sheet detection sensor 130 detects the trailing end of the sheet (Yes in 503), the controller 200 drives, via the conveying motor M2, the conveying roller pairs 306 and 308 located on the second conveying path 120 at the color erasing speed (504). For example, after the sheet detection sensor 130 detects the trailing end of the sheet, the controller 200 drives the conveying motors M1 and M2 by a predetermined number of pulses and conveys the sheet at the reading speed until the trailing end of the sheet passes through the conveying roller pair 304. The controller 200 reduces the conveying speed of the conveying roller pairs 306 and 308 by the conveying motor M2 to the color erasing speed at timing when the trailing end of the sheet conveyed at the reading speed passes through the conveying roller pair 304. The driving of the conveying roller pair 304 is maintained at the reading speed by the conveying motor M1. However, since the conveying roller pair 304 does not nip the sheet at this moment, the sheet can be decelerated by the conveying roller pairs 306 and 308. The conveying roller pair 310 located downstream the conveying roller pair 308 and driven at the color erasing speed via the conveying motor M3 conveys the sheet decelerated to the color erasing speed by the conveying roller pairs 306 and 308 to the color erasing section 108 (505).

FIGS. 6A to 6C and FIG. 7 are diagrams for explaining a mechanism for increasing the conveying speed of the sheet from the color erasing speed to the reading speed when the sheet is conveyed from the color erasing section 108 to the reading section 106 again. If the sheet is conveyed to the reading section 106 after the color erasing processing is performed by the color erasing section 108, the color erasing apparatus 100 increases the conveying speed of the sheet to the reading speed before the sheet reaches the reading section 106.

Figure 6B:
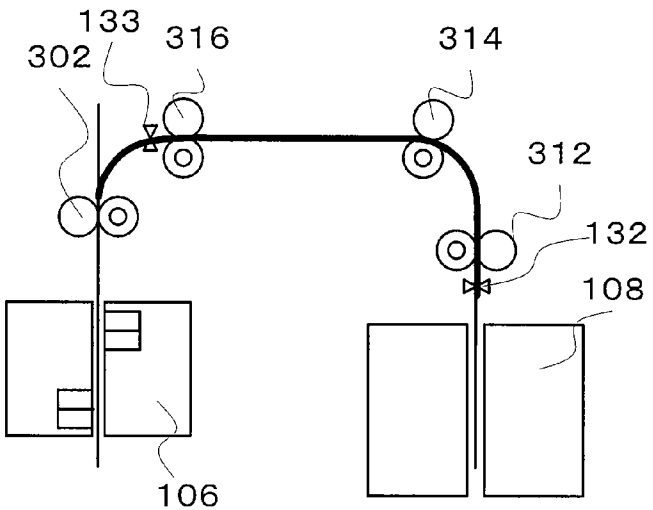
FIGS. 6A to 6C are schematic diagrams for explaining a flow of increasing the conveying speed of the sheet from the color erasing speed to the reading speed when the sheet is conveyed from the color erasing section to the reading section.
Figure 6A:
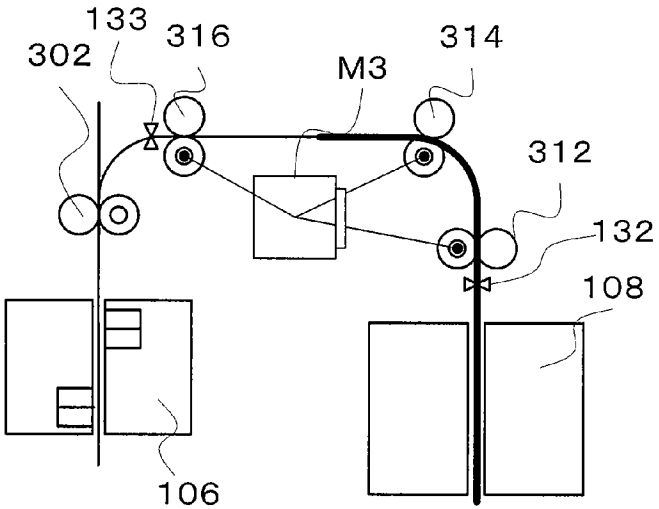
Figure 6C:
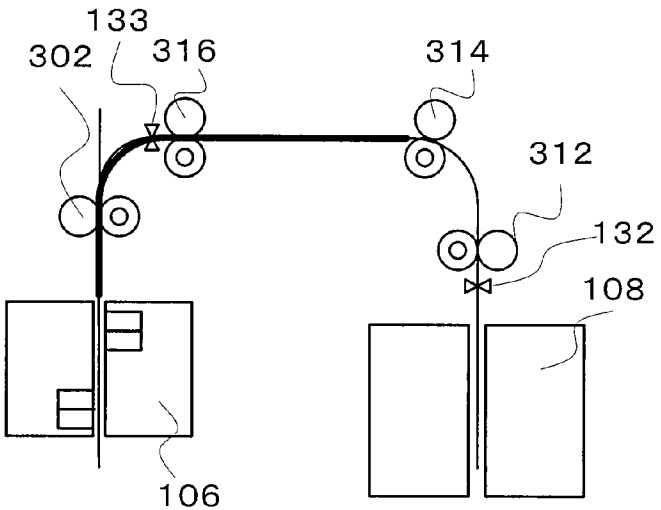

FIGS. 6A to 6C are schematic diagrams for explaining a flow until the sheet conveyed from the color erasing section 108 is accelerated from the color erasing speed to the reading speed. As shown in FIG. 6A, the color erasing apparatus 100 drives the conveying roller pairs 312, 314, and 316 at the color erasing speed via the conveying motor M3. The sheet passing through the color erasing section 108 is conveyed to the reading section 106 at the color erasing speed. As explained above, the conveying roller pairs 312, 314, and 316 driven by the conveying motor M3 includes the one-way clutches in the driving shafts.

FIG. 6B is a diagram of a state in which the trailing end of the sheet conveyed at the color erasing speed by the conveying roller pairs 312, 314, and 316 located downstream the color erasing section 108 passes through the color erasing section 108. The length of the conveying path formed from the color erasing section 108 to the reading section 106 is desirably small for a reduction in size of the apparatus. However, it is undesirable to change the conveying speed of the sheet passing through the color erasing section 108. Therefore, the conveying roller pair 302 arranged on the first conveying path 118 and driven at the reading speed by the conveying motor M1 is arranged in a position where the conveying roller pair 302 comes into contact with the sheet after at least the trailing end of the sheet conveyed by the conveying roller pairs 312, 314, and 316 passes the color erasing position of the color erasing section 108. The conveying roller pair 302 is located in a position where the conveying roller pair 302 nips the sheet in cooperation with at least the conveying roller pair 316 among the plural conveying roller pairs 312, 314, and 316 arranged downstream in the sheet conveying direction of the color erasing section 108. As explained above, the conveying roller pairs located in the positions where the conveying roller pairs nip the sheet in cooperation with the conveying roller pair 302 and driven at the color erasing speed include the one-way clutches in the driving shafts. In the color erasing apparatus 100 according to this embodiment, the conveying roller pair 302 nips the sheet in cooperation with all the conveying roller pairs 312, 314, and 316 arranged downstream in the conveying direction of the color erasing section 108.

As shown in FIG. 6C, when the sheet reaches the conveying roller pair 302, the conveying roller pair 302 conveys the sheet at the reading speed higher than the color erasing speed. Since the conveying roller pairs 312, 314, and 316 include the one-way clutches in the driving shafts, the conveying roller pair 302 forcibly pulls out the sheet from the conveying roller pairs 312, 314, and 316 at the reading speed. In other words, after reaching the conveying roller pair 302, the sheet is conveyed at the reading speed even if the sheet is nipped by the conveying roller pairs 312, 314, and 316. The conveying roller pair 302 conveys the sheet to the reading section 106 at the reading speed. In this way, if the sheet is conveyed from the color erasing section 108 to the reading section 106, i.e., if the conveying speed of the sheet changes from the color erasing speed to the reading speed higher than the color erasing speed, the controller 200 does not need to change the conveying speed. Therefore, since a motor such as the conveying motor M2 configured to change speed is not separately used, the apparatus can be reduced in size.

The conveying roller pair 302 only has to be arranged near the reading section 106 to reduce the size of the apparatus. For example, if the sheet is changed from the color erasing speed to the reading speed, before reaching the reading position of the reading section 106, the sheet only has to be away from the reading position sufficiently for accelerating the sheet to the reading speed.

Figure 7:
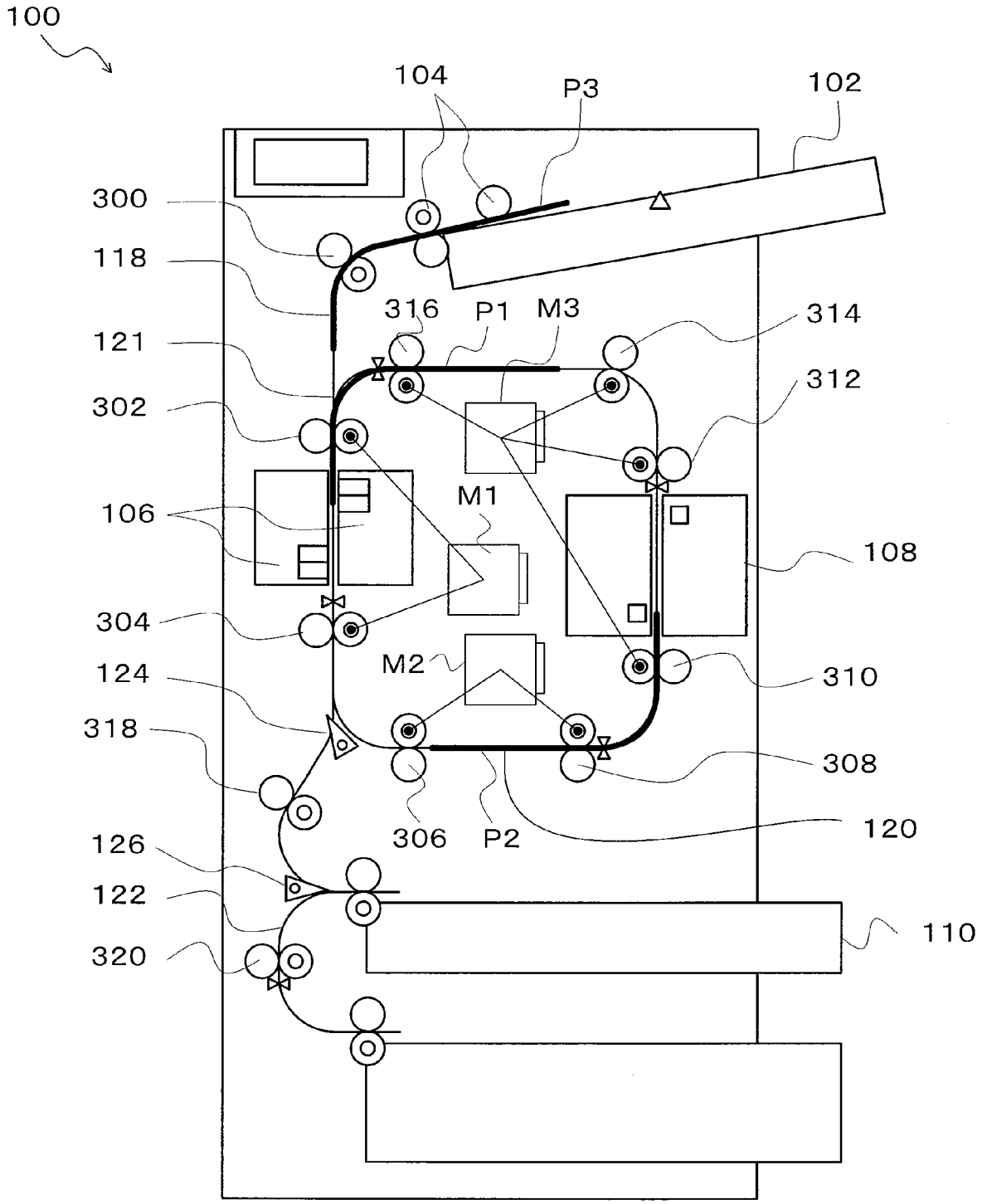
FIG. 7 is a schematic diagram for explaining continuous processing for plural sheets.

FIG. 7 is a diagram for explaining continuous processing for plural sheets. In a state shown in the figure, the reading processing and the color erasing processing for the first sheet P1 end and the sheet P1 is conveyed from the second conveying path 120 to the first conveying path 118, i.e., accelerated from the color erasing speed to the reading speed and conveyed to the reading section 106 to be subjected to the sorting processing. In the state shown in the figure, after the reading section 106 reads an image on the following sheet P2 (reading processing), the sheet P2 is conveyed from the first conveying path 118 to the second conveying path 120, i.e., decelerated from the reading speed to the color erasing speed and conveyed to the color erasing section 108. In the state shown in the figure, a sheet P3 is fed from the paper feeding tray 102 and put on standby before the meeting point 121 of the first conveying path 118 and the second conveying path 120. After the sheet P1 is conveyed to the reading section 106 and before the sheet P2 is conveyed to the reading section 106, the sheet P3 is conveyed to the reading section 106 to be subjected to the reading processing. Specifically, the color erasing apparatus 100 reads images in the reading section 106 in order explained below. The color erasing apparatus 100 performs the reading processing for the first sheet P1, the reading processing for the second sheet P2, the sorting processing for the first sheet P1, the reading processing for the third sheet P3, the sorting processing for the second sheet P2, and the reading processing for a fourth sheet. Finally, the color erasing apparatus 100 performs the sorting processing for a (N−2)th sheet P(N−2), the sorting processing for a (N−1)th sheet P(N−1), and the sorting processing for an Nth sheet PN. N is an integer. The color erasing processing is performed between the reading processing and the sorting processing for the sheets.

As explained above, the color erasing apparatus 100 according to this embodiment includes a circulation route including the first conveying path 118 and the second conveying path 120. The first conveying path 118 forms the conveying path extending from the paper feeding tray 102 to the reuse tray 110. On the first conveying path 118, the reading section 106 and the first diverting member 124 are arranged downstream in the conveying direction of the paper feeding tray 102. On the second conveying path 120, the color erasing section 108 is arranged. The second conveying path 120 branches from the first conveying path 118 in the position where the first diverting member 124 is arranged and meets with the first conveying path 118 at the meeting point 121 between the paper feeding tray 102 and the reading section 106. Consequently, while applying two times of reading for the reading processing and the sorting processing in the reading section 106 to one sheet and performing the reading processing or the sorting processing for the sheet, the color erasing apparatus 100 can simultaneously perform the color erasing processing for another sheet.

The color erasing apparatus 100 according to this embodiment includes the first conveying path and the second conveying path. The first conveying path includes the conveying roller pairs 312, 314, and 316 arranged downstream in the sheet conveying direction of the color erasing section 108 and including the one-way clutches in the driving shafts and the conveying motor M3 configured to drive the conveying roller pairs. The first conveying path conveys the sheet, which passes through the color erasing section 108, at the color erasing speed (the first speed). The second conveying path includes the reading section 106 configured to read an image on the surface of a sheet conveyed at the reading speed (the second speed) higher than the color erasing speed, the conveying roller pair 302 being arranged upstream in the sheet conveying direction of the reading section 106 and in the position at least where the conveying roller pair 302 nips the conveyed sheet in cooperation and simultaneously with the conveying roller pair 316 closest to the first conveying path among the conveying roller pairs 312, 314, and 316 located on the second conveying path 120, and the conveying motor M1 configured to drive the conveying roller pair 302. The second conveying path conveys the sheet to the reading section 106 at the reading speed. In other words, according to the embodiment explained above, the color erasing apparatus 100 makes it possible to simultaneously perform the reading processing or the sorting processing in high-speed conveyance by the reading section 106 and the color erasing processing in low-speed conveyance by the color erasing section 108. This makes it possible to improve processing performance of the color erasing apparatus 100 and realize a reduction in size of the apparatus.

As explained above, if processing for two sheets, i.e., the color erasing processing for a sheet performed by the color erasing section 108 and the reading processing and the sorting processing for another sheet by the reading section 106 are performed in parallel, the reading speed is desirably twice or more as high as the color erasing speed.

Entities that execute the operations in the embodiment are entities related to a computer such as hardware, a complex of the hardware and software, the software, and software being executed. Entities that execute the operations are, for example, a process executed on a processor, the processor, an object, an execution file, a thread, a computer program, and a computer but are not limited to these entities. The process or the thread may be caused to play plural entities that execute the operations.

While certain embodiments have been described, these embodiments have been presented by way of example only, and are not intended to limit the scope of invention. Indeed, the novel apparatus described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. A color erasing apparatus comprising:

a color erasing section configured to erase a color of an image formed with an erasable color material on a sheet conveyed at first speed;

a first conveying section including a first conveying roller and a first driving section configured to convey the sheet, which passes through the color erasing section, at the first speed, the first conveying roller being arranged downstream in a sheet conveying direction of the color erasing section and configured to convey the sheet, the first driving section being configured to drive the first conveying roller, wherein the first conveying roller includes a one-way clutch in a driving shaft of the first conveying roller;

a reading section configured to read an image on a surface of the sheet conveyed at second speed higher than the first speed; and a second conveying section including a second conveying roller and a second driving section configured to convey the sheet to the reading section at the second speed, the second roller being arranged upstream in the sheet conveying direction of the reading section and in a position where the second conveying roller nips the conveyed sheet in cooperation and simultaneously with the first conveying roller, the second driving section being configured to drive the second conveying roller.

2. The apparatus according to claim 1, wherein the second conveying section forcibly conveys the sheet in the sheet conveying direction at the second speed by the second conveying roller from the first conveying roller conveying the sheet at the first speed.

3. The apparatus according to claim 2, wherein the second conveying roller is provided in a position where the second conveying roller nips the sheet in cooperation with the first conveying roller after a trailing end of the sheet conveyed by the first conveying roller passes a color erasing position of the color erasing section.

4. The apparatus according to claim 3, further comprising:

a discharge section configured to discharge the sheet;

a switching section provided downstream in the sheet conveying direction of the reading section, the switching section being configured to switch the sheet conveying direction to a direction of the discharge section or a direction of the color erasing section;

a third conveying roller configured to convey the sheet, which is conveyed from the reading section, to the switching section at the second speed;

a detecting member configured to detect a trailing end of the sheet conveyed by the third conveying roller;

a fourth conveying roller arranged between the switching section and the color erasing section and in a position where the fourth conveying roller nips the conveyed sheet in cooperation and simultaneously with the third conveying roller, the fourth conveying roller being configured to convey the sheet to the color erasing section at the second speed; and a controller configured to switch conveying speed of the sheet to the color erasing section by the fourth conveying roller from the second speed to the first speed, if the sheet conveyed by the third conveying roller is guided to the color erasing section by the switching section, and if the detecting member detects the trailing end of the sheet.

5. The apparatus according to claim 4, further comprising:

a paper feeding section configured to feed the sheet;

a first conveying path that forms a conveying path extending from the paper feeding section to the discharge section and on which the reading section and the switching section are arranged downstream in the sheet conveying direction of the paper feeding section; and a second conveying path that branches from the first conveying path in a position where the switching section is arranged and meets with the first conveying path at a meeting point between the paper feeding section and the reading section and on which the color erasing section is arranged.

6. The apparatus according to claim 5, wherein the controller switches the conveying speed of the sheet to the color erasing section by the fourth conveying roller from the second speed to the first speed after at least the trailing end of the sheet conveyed by the third conveying roller passes an image reading position of the reading section and before the conveyed sheet reaches a color erasing position of the color erasing section.

7. The apparatus according to claim 6, further comprising a third driving section configured to drive the fourth conveying roller, wherein the third conveying roller is driven by the second driving section.

8. The apparatus according to claim 5, wherein the first conveying roller is arranged on the second conveying path and between the color erasing section and the meeting point, and the second conveying roller is arranged on the first conveying path and between the meeting point and the reading section.

9. The apparatus according to claim 6, wherein the third conveying roller is arranged on the first conveying path and between the reading section and the switching section, and the fourth conveying roller is arranged on the second conveying path and between the switching section and the color erasing section.

10. A color erasing apparatus comprising:

a paper feeding section configured to feed a sheet;

a discharge section configured to discharge the sheet;

a first conveying path that forms a conveying path extending from the paper feeding section to the discharge section;

a reading section arranged on the first conveying path and configured to read an image on a surface of the sheet conveyed at reading speed;

a color erasing section configured to erase a color of an image formed with an erasable color material on the sheet conveyed at color erasing speed lower than the reading speed;

a switching section arranged on the first conveying path and downstream in a sheet conveying direction of the reading section and configured to switch the sheet conveying direction to a direction of the discharge section or a direction of the color erasing section;

a second conveying path that branches from the first conveying path in a position where the switching section is arranged and meets with the first conveying path at a meeting point between the paper feeding section and the reading section and on which the color erasing section is arranged;

a first conveying roller configured to convey the sheet, which is conveyed from the reading section, to the switching section at the reading speed;

a second conveying roller arranged between the switching section and the color erasing section and in a position where the second conveying roller nips the conveyed sheet in cooperation with the first conveying roller and configured to convey the sheet to the color erasing section at the reading speed;

a controller configured to switch conveying speed of the sheet to the color erasing section by the second conveying roller from the reading speed to the color erasing speed after the sheet conveyed at the reading speed passes through the reading section;

a third conveying roller arranged downstream in the sheet conveying direction of the color erasing section along the second conveying path, including a one-way clutch in a driving shaft, and configured to convey the sheet, which passes through the color erasing section, at the color erasing speed; and a fourth conveying roller arranged between the third conveying roller and the reading section and in a position where the fourth conveying roller nips the conveyed sheet in cooperation and simultaneously with the third conveying roller and configured to pull out the sheet from the third conveying roller in the sheet conveying direction at the reading speed and convey the sheet to the reading section.

11. The apparatus according to claim 10, wherein the first conveying roller is arranged on the first conveying path and between the reading section and the switching section, and the fourth conveying roller is arranged on the first conveying path and between the reading section and the meeting point.

12. The apparatus according to claim 10, wherein the reading section reads images on both sides of the sheet conveyed at the reading speed.

13. The apparatus according to claim 10, wherein the color erasing section erases colors of images on both sides of the sheet conveyed at the color erasing speed.

14. The apparatus according to claim 10, further comprising:

a first driving motor configured to drive the first conveying roller and the fourth conveying roller at the reading speed;

a second motor configured to drive the second conveying roller; and a third motor configured to drive the third conveying roller at the color erasing speed.

15. A color erasing apparatus comprising:

color erasing means for erasing a color of an image formed with an erasable color material on a sheet conveyed at first speed;

first conveying means arranged downstream in a sheet conveying direction of the color erasing means and for conveying the sheet, which passes through the color erasing means, at the first speed, the first conveying means including a one-way clutch;

reading means for reading an image on a surface of the sheet conveyed at second speed higher than the first speed; and second conveying means arranged upstream in the sheet conveying direction of the reading means and in a position where the second conveying means nips the conveyed sheet in cooperation and simultaneously with the first conveying means and for conveying the sheet to the reading means at the second speed.

16. The apparatus according to claim 15, wherein the second conveying means forcibly pulls out the sheet from the first conveying means, which conveys the sheet at the first speed, in the sheet conveying direction at the second speed.

* * * * *